US005253018A

United States Patent [19]

Takeuchi et al.

[11] Patent Number: 5,253,018

[45] Date of Patent: Oct. 12, 1993

[54] TONER IMAGE DENSITY DETECTING MECHANISM FOR IMAGE FORMING APPARATUS

[75] Inventors: Tatsuo Takeuchi, Kawasaki; Koji Amemiya, Tokyo; Takao Ogata, Yokohama; Nobuatsu Sasanuma, Yamato, all of Japan

[73] Assignee: Canon Kabushiki Kaisha, Tokyo, Japan

[21] Appl. No.: 839,366

[22] Filed: Feb. 21, 1992

[30] Foreign Application Priority Data

Feb. 22, 1991 [JP] Japan ..... 3-028612

[51] Int. Cl.[5] ..... G03G 21/00

[52] U.S. Cl. ..... 355/246; 118/688; 118/689; 118/690; 118/691; 355/203; 355/204; 355/208

[58] Field of Search ..... 355/208, 203, 204, 245, 355/246, 214, 219; 118/690, 691, 689, 688; 430/109, 111, 114

[56] References Cited

U.S. PATENT DOCUMENTS

| | | | |
|---|---|---|---|
| 4,575,224 | 3/1986 | Arnold | 355/203 |
| 4,883,019 | 11/1989 | Menjo et al. | 118/691 |
| 4,894,685 | 1/1990 | Shoji | 355/246 |
| 5,045,883 | 9/1991 | Ishigaki et al. | 355/246 X |
| 5,103,260 | 4/1992 | Tompkins et al. | 355/208 |

FOREIGN PATENT DOCUMENTS

| | | | |
|---|---|---|---|
| 0192978 | 2/1982 | Japan | 355/246 |
| 0030567 | 2/1984 | Japan | 355/204 |
| 0200169 | 8/1988 | Japan | 355/246 |
| 0149864 | 6/1990 | Japan | 355/246 |

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

The present invention relates to a toner image density detecting mechanism for an image forming apparatus which includes an image bearing layer supported on a rotatable cylindrical member, a device for forming a plurality of toner reference patterns on the image bearing layer at respective positions which equally divide a circumference of the cylindrical member, a detector for detecting an image density of the toner image of the reference pattern, and a controller controlling an image forming condition in accordance with an output of the detector; wherein an average of the image densities is determined for use in a control operation of the controller. Preferably, the toner used has a reflective or absorbing rate not less than 1.5 times that of the image bearing layer.

9 Claims, 3 Drawing Sheets

TONER IMAGE DENSITY DETECTING MECHANISM FOR IMAGE FORMING APPARATUS

FIELD OF THE INVENTION AND RELATED ART

The present invention relates to an image forming apparatus such as an electrophotographic apparatus, and more particularly to an image forming apparatus wherein a reference toner image is formed on an image bearing member such as a photosensitive member, and the density of the toner image is detected, which density is used to control image forming conditions.

In a known detecting means for detecting the density of a toner image on a photosensitive member in an image forming apparatus such as an electrophotographic machine, a light having a predetermined wavelength is projected onto the toner image, and the quantity of light reflected by the toner image is detected, so that the image density of the toner image is determined.

Referring to FIGS. 4A and 4B, such a detecting method will be described. As shown in FIG. 4A, the photosensitive member is rotated in a direction indicated by an arrow C. The photosensitive member 1 is charged by a charger 2 to a predetermined potential. Then, the photosensitive member is exposed to image light 9 corresponding to a reference toner image 8 as shown in FIG. 4B. The electrostatic latent image thus produced is developed by a developing device 3 containing a known two component or one component developer, into a toner image 8, which is then presented to light sensors 6 and 7.

In this position, the toner image 8 is irradiated with light from a light source 6 in the form of an LED lamp or the like, and the light reflected by the toner image 8 is received by a photoreceptor 7. Thus, the image density of the toner image 8 is detected. The toner image 8 from which the image density has been detected is removed by the photosensitive member 1 by cleaning means 5. Thus, the photosensitive member is now prepared for the next toner image density detection operation or for the normal image forming operation. The image forming apparatus comprises an image transfer charger 4a for transferring the image from the photosensitive member 1 to sheet material (not shown), a separation discharger for separating the sheet material from a photosensitive member 1, and a pre-exposure light source 12.

On the basis of the toner image thus produced, operating conditions or parameters such as the toner content in the developing device 3, the developing bias, the charging potential of the charger, the exposure amount or the like in the electrophotographic apparatus are determined.

In the toner image density detection on the photosensitive member by optical means, when the distance between the light source 6 and the photoreceptor element 7 and the surface of the photosensitive member 1 changes, the detected density varies in accordance with the square of the distance therebetween. In order to avoid this problem, it is required not only to enhance the circularity of the photosensitive member 1 but also to enhance the manufacturing accuracies of the driving shaft for rotating the photosensitive member 1 and the mechanical parts including gears or the like. However, it is difficult to completely maintain the constant distance between the photosensitive member 1 and the light source 6 or the photoreceptor element 7. Therefore, a problem exists in that the accurate detection of the toner image density is difficult.

SUMMARY OF THE INVENTION

Accordingly, it is a principal object of the present invention to provide an image forming apparatus, in which the image density of a reference toner image having a predetermined pattern on an image bearing member is correctly detected.

According to one aspect of the present invention, there is provided a toner image density detecting mechanism for an image forming apparatus, comprising: an image bearing layer supported on a rotatable cylindrical member; means for forming a reference pattern with a toner on the image bearing layer; detecting means for detecting an image density of the toner image of the reference pattern; and means for controlling an image forming condition in accordance with an output of the detecting means; wherein a plurality of such reference patterns are formed at respective positions which equally divide a circumference of the cylindrical member, and an average thereof is determined for a control operation of the control means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
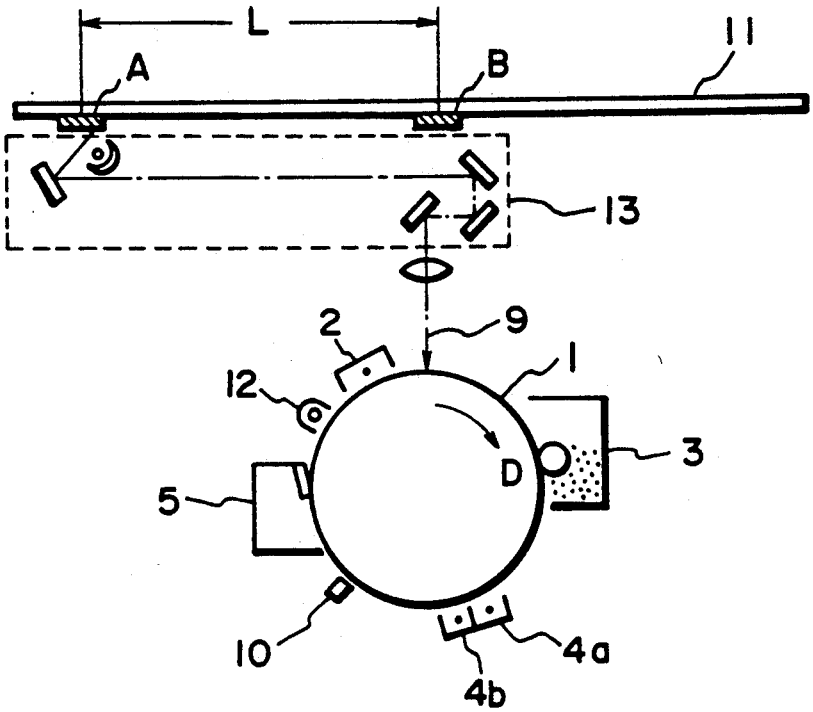
FIG. 1 is a sectional view of an image forming apparatus according to an embodiment of the present invention.

Referring now to FIG. 1, there is shown an electrophotographic copying apparatus according to an embodiment of the present invention.

On a bottom surface of an original supporting platen glass 11 outside an image formation region, pattern images A and B having a predetermined image density for toner image density measurement, are disposed with a distance L therebetween. The distance L corresponds to one half the circumferential difference of a cylindrical member which is a base of the photosensitive drum. The photosensitive drum 1 includes an image bearing member in the form of a photoconductive layer on the cylindrical member.

Figure 2:
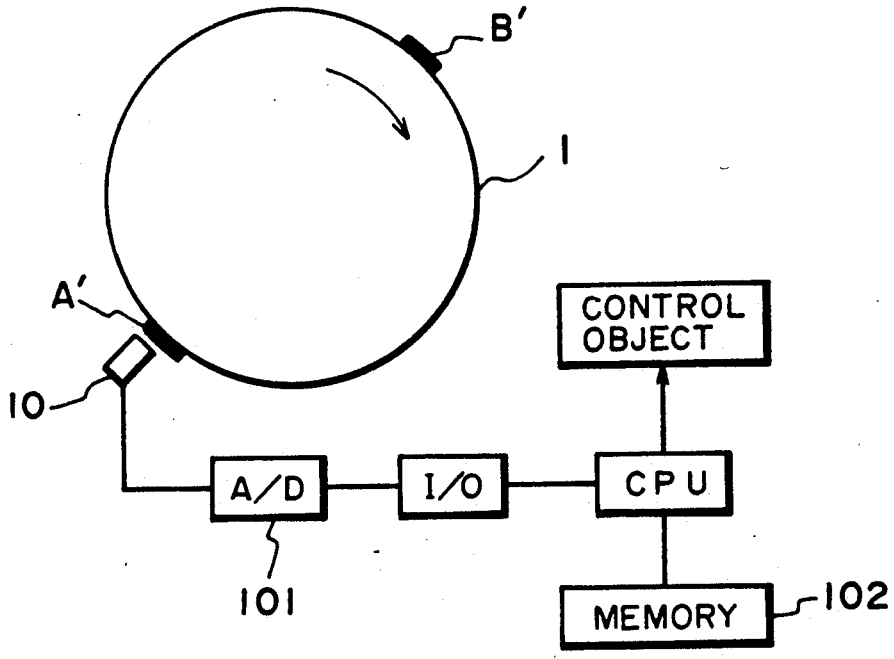
FIG. 2 illustrates a method of detecting an image density of a reference toner image.

The following is a description of the toner density measurement on the photosensitive drum 1 using the pattern images A and B. First, the photosensitive drum 1 rotates in a direction D. Through a known electrophotographic step, the photosensitive drum 1 is uniformly charged by a charger 2. Then, the optical system 13 moves at the same peripheral speed as the photosensitive drum in accordance with the rotation of the photosensitive drum 1, and the light image corresponding to the pattern image A is projected, so that a corresponding electrostatic latent image is formed. The latent image is developed by a developing device 3 into a reference toner image A'. As shown in FIG. 2, the toner image A' is presented to the position of the photodetector element 10 constituted by a light emitting source and a photoreceptor. Here, it receives light from a light emitting source in a photodetector element, and the light reflected thereby is detected by the photoreceptor which produces a signal in the form of a current or voltage corresponding to the image density. It is preferable to know the level of the light quantity reflected by the bare surface of the photosensitive drum 1 at the position where the toner image A' is formed, since then, the image density signal only from the toner image can be determined.

During the movement of the toner image A' to the position where it is faced to the photodetector element 10, the optical system 13 further moves to expose the photosensitive drum 1 to the pattern image B which is apart from the toner image A' by a distance L which is one half the circumferential length of the photosensitive drum 1. The thus formed electrostatic latent image is developed by the developing device 3, similarly to the toner image A', into a reference toner image B'. The photodetector element 10 detects the density thereof.

The densities of the reference toner images A' and B', thus detected, are converted to binary signals by an A/D converter 101, as shown in FIG. 2. They are added in a memory 102, and an average thereof is determined as a true toner image density. It is then compared with a proper level which has been stored in memory beforehand. In accordance with a comparison result thereof, the toner supply, developing bias voltage, charging voltage, exposure amount, or another image forming condition or parameter can be controlled in accordance with instruction from a CPU.

In the foregoing, the toner detecting operation in the present invention has been described. The toner of which the density of the image can be detected is of a material absorbing or reflecting light having a wavelength in a predetermined range. In the case of an absorbing type toner, it is desirable that the photosensitive drum on which the toner image is formed has a lower absorption rate than the toner. Otherwise, the reflection type is desirable. If the reflection type is used, the reflection rate of the photosensitive drum is lower than the toner. Otherwise, the absorption type is preferable. More particularly, when the reflection type or absorption type is used, the reflection rate or the absorption rate of the toner is not less than 1.5 times that of the photosensitive drum.

The following is a description of the photodetection sensor used in this embodiment. The sensor comprises an illumination source for emitting light to the photosensitive drum 1 and a photoreceptor for receiving light reflected by the photosensitive member and the toner. The photosensor may be in the form of a photodiode, phototransistor, a combination thereof with a charge coupling element, or the like. As for the illumination source, a wide wavelength range visible light source such as a halogen lamp, tungsten lamp or the like, and a narrow band-width light source such as an LED, semiconductor laser or the like, may be selected in accordance with the spectrum properties of the toner and the photosensitive member. If desired, a color filter or the like may be used to remove light having a wavelength other than the desired wavelength(s).

Figure 3A:
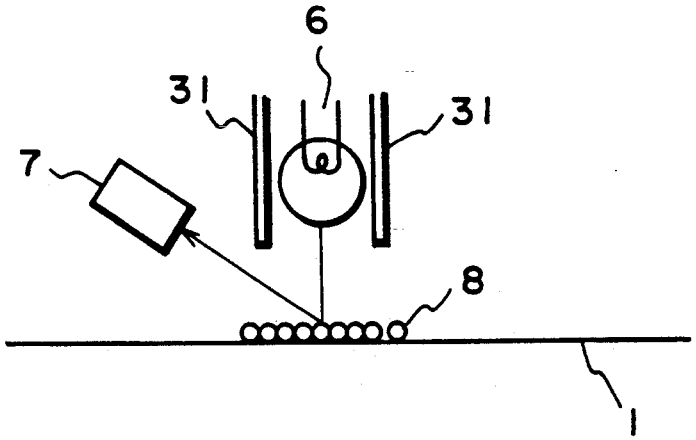
FIGS. 3A and 3B illustrate details of a photodetecting sensor of the present invention.
Figure 3B:
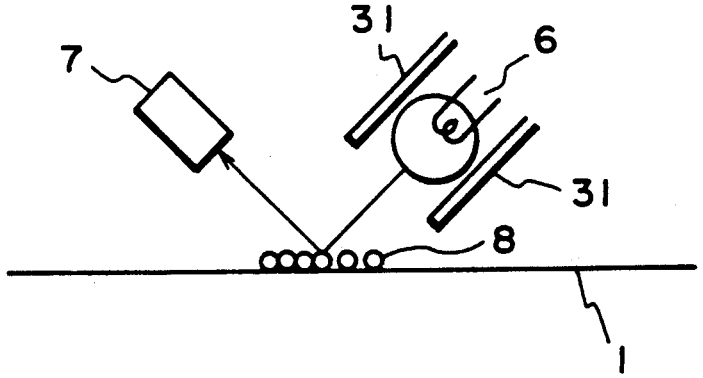
Figure 4A:
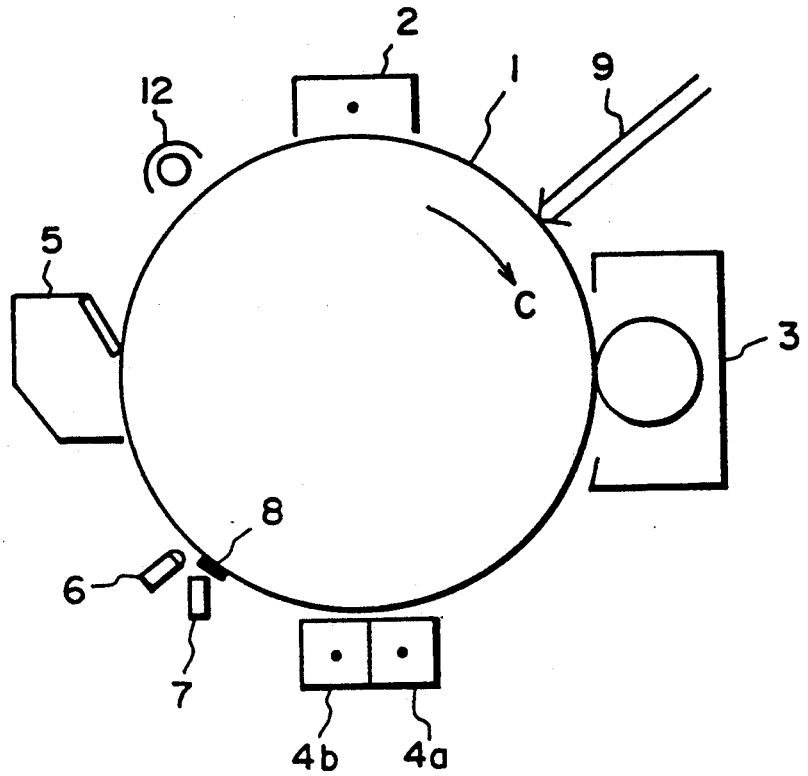
FIG. 4A (PRIOR ART)
FIGS. 4A and 4B illustrate toner image density detecting method in a conventional image forming apparatus.
Figure 4B:
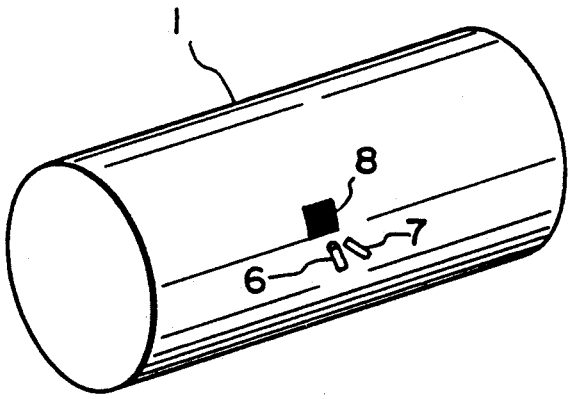
FIG. 4B (PRIOR ART)

FIG. 3A shows another toner image density detecting method, wherein the light is projected to the toner image 8 from the light source 6 covered with a light blocking plate 31 for preventing direct light, and the scattered light is detected by the photosensor 7 (scattered light detecting method). FIG. 3B shows a further example wherein the light from the light source with the similar light blocking plate 31 is directed to the toner image 8, and the specularly reflected light component is also detected. Each of these methods is usable with the present invention.

Examples of the embodiment of the present invention will be described. In one example, irregularly shaped pulverized black toner comprising polyester resin binder and the carbon fine are used. The volume average particle size is 8 microns. The photosensitive drum comprised a cylindrical drum having a diameter of 80 mm and an organic photosensitive layer comprising as a binder a polycarbonate resin material. The photosensor 10 comprised an illumination source in the form of an LED producing a wavelength 980 nm light, and the photosensor comprised a phototransistor. The measuring used was the disturbed light measuring method of FIG. 3A.

In accordance with the method described in FIGS. 1 and 2, two pattern images of the same toner density were formed on the photosensitive drum at the circumferential interval equal to one half thereof. An average of the two toner image densities was determined. Then, the pattern forming portions were varied by an amount equal to ¼ the circumferential length with the interval therebetween maintained, and the same measurements were carried out. A comparison was made between the values of the former and the latter cases, and the difference of the measured values was not more than 1% relative to the measured density.

As a Comparison Example, only one pattern image was formed, and the same measurements were effected under the same conditions, and then, the second measurements were carried out after the image forming position was varied by an amount equal to ¼ the circumferential length. The difference in the measurement values was not less than 10%.

The distances between the photodetecting element and the surface of the photosensitive drum were measured for the above described Example and Comparison Example, and it has been confirmed that the ¼ circumferential deviation of the photosensitive drum results in a change of in the distance of approximately 5%. Thus, the embodiment is effective to remove the influence due to the distance change.

The photosensitive drum used in the above Example and the Comparison Example had high circularity. Thus, the embodiment is effective when the rotational axis is eccentric. If the rotational axis is concentric, but the circularity of the drum base member is low, for example, it is somewhat oval, it is desirable that the reference toner images are formed at four positions which equally divide the circumference of the cylindrical member, in order to correctly measure the toner image density. Practically, in the case of an analog copying machine, four pattern images are formed on the original supporting platen glass of FIG. 1 at regular intervals. An alternative method of density detection is to increase the movement speed of the optical system in FIG. 1, so that the scanning operation is carried out twice during one full rotation of the photosensitive drum. When consideration is to be paid to both of the eccentricity of the rotational axis and the poor circularity, the number of pattern images can be increased, as desired.

In the embodiment of FIG. 1, the pattern images are formed on the bottom surface of the original supporting platen glass in the non-image-formation region. This is not limiting, and alternative arrangement includes movable pattern images which are placed into the image formation region of the original supporting platen glass during the toner image density measurement mode.

The foregoing description has been made with respect to an analog type copying machine. In the case of an image forming apparatus using a laser beam or the like to form a latent image, the actuation of the laser beam is controlled at proper timing in accordance with rotation of the photosensitive drum, and a latent image of a predetermined pattern is formed, which is then developed into reference toner images.

The density level of the produced pattern image is not limited to one level, but the patterns have different density levels. In this case, an even number of pattern images are produced for each of the density levels, and the average is provided.

The foregoing description has been made as to a monochromatic image forming apparatus. However, the present invention is applicable to a multi-color image forming apparatus capable of forming full-color images. In this case, the present invention is applied to each of the respective color developers.

The image bearing member is not limited to the drum type, but may be in the form of a belt stretched between two cylindrical members. In this case, the present invention is particularly effective when the reference toner image density is detected at a position facing the cylindrical members supporting the belt.

As described in the foregoing, according to the present invention, the density of the toner image on the image bearing member can be detected accurately. Even if the cylindrical member rotating and having the image bearing layer is eccentric or has a poor circularity with the result of variation in the distance between the detecting means and the cylindrical member, ideal detection is accomplished.

While the invention has been described with reference to the structures disclosed herein, it is not confined to the details set forth and this application is intended to cover such modifications or changes as may come within the purposes of the improvements or the scope of the following claims.

What is claimed is:

1. A toner image density detecting mechanism for an image forming apparatus, the mechanism comprising:
an image bearing layer supported on a rotatable cylindrical member;
means for forming a reference pattern image with a toner on said image bearing layer;
detecting means for detecting an image density of the toner image of the reference pattern; and
means for controlling an image forming condition in accordance with an output of said detecting means;
wherein an even number of such reference patterns are formed at respective positions which equally divide a circumference of the cylindrical member, and an average thereof is determined for use in a control operation of said control means, and
wherein, in accordance with toner type, a reflection or absorption rate of the toner is not less than 1.5 times that of said image bearing layer.

2. A mechanism according to claim 1, wherein said image bearing layer is supported on one such cylindrical member.

3. A mechanism according to claim 1, wherein said image bearing layer is in the form of a belt supported around a plurality of such cylindrical members.

4. A mechanism according to claim 1, wherein the number is two.

5. A mechanism according to claim 1, wherein the number is four.

6. A mechanism according to claim 1, wherein the reference pattern of the toner absorbs light.

7. An image forming apparatus, comprising:
an image bearing layer supported on a rotatable cylindrical member;
means for forming a plurality of reference patterns with a toner on said image bearing layer at respective positions which equally divide a circumference of the cylindrical member;
detecting means for detecting an image density of the toner image of a reference pattern; and
means for controlling an image forming condition in accordance with an output of said detecting means;
wherein an average of the image densities detected by said detecting means is determined for use in a control operation of said control means, and
wherein, in accordance with toner type, a reflection or absorption rate of the toner is not less than 1.5 times that of said image bearing layer.

8. An image forming apparatus, comprising:
an image bearing layer supported on a rotatable cylindrical member;
means for forming an even number of reference patterns with a toner on said image bearing layer at respective positions which equally divide a circumference of the cylindrical member;
detecting means for detecting an image density of the toner image of a reference pattern; and
means for controlling an image forming condition in accordance with an output of said detecting means;
wherein an average of the image densities detected by said detecting means is determined for use in a control operation of said control means, and
wherein, in accordance with toner type, a reflection or absorption rate of the toner is not less than 1.5 times that of said image bearing layer.

9. A toner image density detecting mechanism for an image forming apparatus, said mechanism comprising:
an image bearing layer supported on a rotatable cylindrical member;
means for forming a plurality of reference patterns with a toner on said image bearing layer at respective positions which equally divide a circumference of the cylindrical member;
detecting means for detecting an image density of a toner image of a reference pattern; and
means for controlling an image forming condition in accordance with an output of said detecting means;
wherein an average of the image densities detected by said detecting means is determined for a control operation of said control means, and
wherein, in accordance with a toner type, a reflection or absorption rate of the toner is not less than 1.5 times that of said image bearing layer.

* * * * *

UNITED STATES PATENT AND TRADEMARK OFFICE

CERTIFICATE OF CORRECTION

PATENT NO. 5,253,018

DATED October 12, 1993

INVENTOR(S) TAKEUCHI ET AL.

It is certified that error appears in the above-indentified patent and that said Letters Patent is hereby corrected as shown below:

Column 2

Line 39, change "toner" to --a toner--.

Column 4

Line 15, change "fine" to --fine particles--.
Line 23, change "ing" to --ing method--.
Line 49, delete "of" (first occurrence).

Signed and Sealed this

Third Day of May, 1994

Bruce Lehman

*Attest:*

BRUCE LEHMAN

*Attesting Officer*

*Commissioner of Patents and Trademarks*